United States Patent [19]

Wright

[11] Patent Number: 4,613,063

[45] Date of Patent: Sep. 23, 1986

[54] DISPENSING PACKAGE

[75] Inventor: David M. Wright, Evansville, Ind.

[73] Assignee: Sunbeam Plastics Corporation, Evansville, Ind.

[21] Appl. No.: 689,161

[22] Filed: Jan. 7, 1985

[51] Int. Cl.[4] ..... B65D 55/02

[52] U.S. Cl. ..... 222/153; 222/485; 222/541; 222/548; 222/553; 220/270

[58] Field of Search ..... 222/541, 548, 553, 559, 222/153, 83, 478, 480, 481, 482, 484, 485; 220/257, 270, 253; 215/216; 221/82, 83, 89, 91

[56] References Cited

U.S. PATENT DOCUMENTS

| | | | |
|---|---|---|---|
| 2,361,047 | 10/1944 | Morey | 222/553 |
| 3,042,273 | 7/1962 | Bauer et al. | 222/548 |
| 3,081,011 | 3/1963 | Stull | 222/153 |
| 3,323,683 | 6/1967 | Cianciolo | 222/480 X |
| 3,355,069 | 11/1967 | Miles | 222/83 |
| 3,984,021 | 10/1976 | Uhlig | 215/216 |
| 3,993,209 | 11/1976 | Julian | 215/216 |
| 4,376,497 | 3/1983 | Mumford | 222/153 |
| 4,410,097 | 10/1983 | Kusz | 215/216 X |
| 4,500,016 | 2/1985 | Funfstuck | 222/153 |
| 4,541,541 | 9/1985 | Hickman et al. | 220/253 |

FOREIGN PATENT DOCUMENTS

| | | | |
|---|---|---|---|
| 572389 | 6/1924 | France | 222/548 |
| 1111447 | 10/1955 | France | 222/548 |

*Primary Examiner*—Joseph J. Rolla
*Assistant Examiner*—Edward S. Ammeen
*Attorney, Agent, or Firm*—Irvin L. Groh

[57] ABSTRACT

A three piece safety dispensing package for granular or pellet material. A cap is rotatably attached to a container. The cap has dispensing windows that are aligned with openings in the container to a desired degree to control the dispensing rate. The cap can have child resistant locking tabs which engage recesses on the container to maintain the cap locked in a closed position with the cap dispensing windows out of registration with the container openings; opening requires squeezing of the cap to permit rotation to the dispensing position. A tamper indicating tab can be used to prevent rotation until the tab has been broken. The container is filled with product through its open bottom after child resistant lock or tamper indicating tab has been preset as the cap is affixed to the container. The package is finally sealed by introducing a snap-in plug bottom into the open container bottom.

25 Claims, 11 Drawing Figures

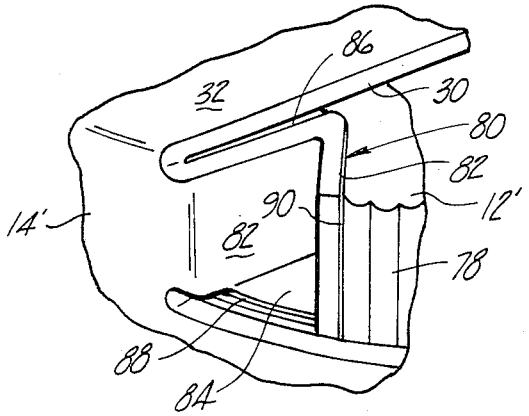
Fig-7
Fig-8
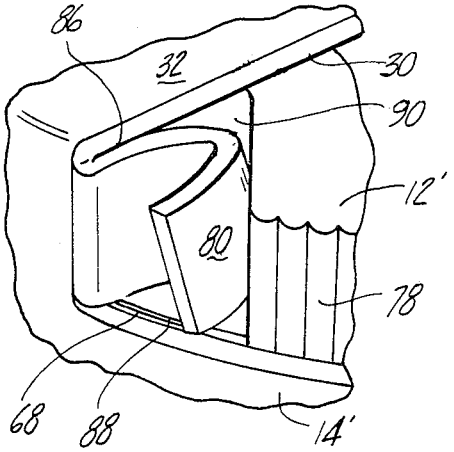
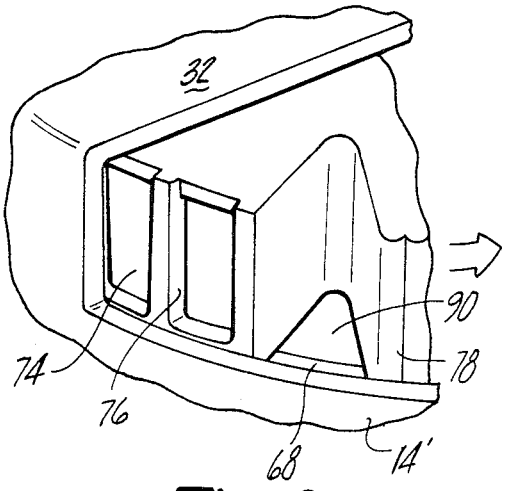
Fig-9
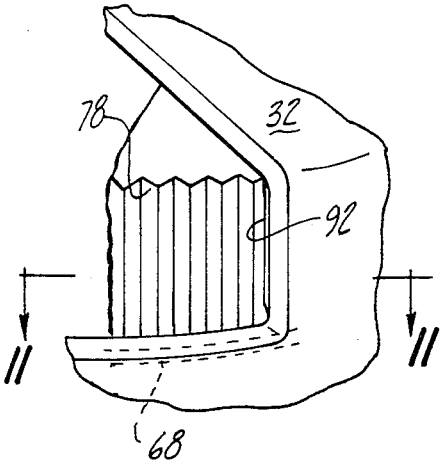
Fig-10
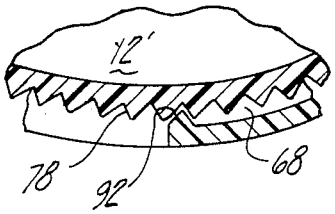
Fig-11

DISPENSING PACKAGE

BACKGROUND OF THE INVENTION

This invention relates to a safety dispenser and more particularly to a three piece safety dispensing package for granular or pellet material.

DESCRIPTION OF THE RELATED ART

There are a wide variety of safety closures or safety closure and container packages which are made with child resistant features which usually require two sequential or simultaneous motions for opening or which are made with a tamper proof feature which has means for indicating when the package has been tampered or initially opened and may have an additional tamper resistant feature which requires an unusual, one time, effort for initial opening, eliminating an accidental first opening. Most of these safety packages are designed for prescription drug and capsule use with a smaller number designed for dispensing liquids. Relatively little attention has been directed toward dispensers for granular or pellet type material and to larger packages designed for rapid, easy initial filling.

It is, therefore, a general object of this invention to provide a dispenser for granular or pellet type material which can be made with a child resistant or tamper indicating feature while providing ease in initial package filling.

It is another object of this invention to provide a safety package for dispensing granular or pellet material in which a dispensing window opening can be adjusted for controlling the rate at which the material is dispensed.

It is still a further object of this invention to provide a dispenser for granular type material which can be filled independently of the dispensing windows, and where the initial tamper indicating or child resistant feature is in a closed or sealed position.

SUMMARY OF THE INVENTION

The objects of this invention are accomplished by a three piece dispensing package in which the first piece is an open bottom cylindrical container having a dispensing opening at its top. The second piece is a cylindrical cap which has a dispensing opening in the form of at least one circumferential slot window and which is rotatably attached to the container top for rotation between a first closed position in which the cap window is closed or out of registration with the container opening to a second open position in which the cap window is aligned to a desired degree with the container opening for dispensing the contents of the container. The third piece is a container bottom in the form of a plug, which after the container has been filled through its open bottom, can be snapped into place to form a bottom seal. The container and cap can have cooperating tamper indicating means to initially seal the dispensing window prior to filling, or they may have cooperating child resistant locking tabs and recesses, locking the cap and container together in its closed position prior to filling and snapping the bottom in place. The top of the container is molded with two diametrically opposed circular segments removed to a depth equal to approximately the height of the cap skirt which defines two vertical chordal surfaces and a bridge joining the tops of the surfaces.

In one embodiment the opening at the container top is in the form of two diametrically opposed circumferential slot windows formed in the bridge arranged for registration with a pair of windows in the cap in the second dispensing position. The container cap has, equally spaced between its two dispensing windows, a pair of diametrically opposed axial locking lugs depending from its skirt, and the container has a pair of complementary lug recesses. The cap lugs engage the container recesses when the cap is in its first closed position releasably locking the cap against rotation. The cap is released for rotation by squeezing the cap skirts at points that are aligned with the chordal surfaces on the container which moves the cap lugs radially outward from the container recesses to permit rotation of the cap to the second dispensing position in which the cap windows are aligned to a desired degree with the container windows. The cap is normally formed with an inner wall located concentric with the outer skirt. This inner wall is formed with a radially inwardly extending circumferential bead, and the container is formed with a complementary radially outward extending circumferential bead. The cap is assembled to the container by placing the cap over the container top with the cap locking lugs in line with the container recesses and then exerting a downward force which snaps the cap bead past the container bead for retention of the cap relative to the container by the coaction of the beads which permits the desired relative rotation. This provides a child resistant cap and container package.

The cap may be formed without a second, internal wall but still formed with a snap-lock type of closure by forming the inwardly extending circumferential bead on the cap skirt to coact with a bead on the container. A tamper indicating and tamper resistant package is created by forming removable tamper indicating locking tabs integral with and occupying a substantial portion of the cap dispensing windows. These removable tamper indicating tabs are formed with a top surface attached to and forming a part of the top surface of the cap by frangible connecting webs. This web connection can be in the form of circumferential frangible webs on the radially inward and radially outward sides of the dispensing windows which join the top surfaces of tabs to the top of the cap. The flat portions of the tabs have depending flanges which engage the chordal surfaces of the container when the cap is snapped into position on the container. This prevents any rotation of the cap until these tamper indicating tabs are removed by grasping the top portion by a finger or implement inserted in the open part of the cap dispensing window and pulling upward to break the two circumferential frangible webs. Both tabs must be removed before the cap can be rotated to a dispensing position. This provides an easily observed tamper indication and a tamper resistant package which cannot accidently be opened.

In another embodiment, the top of the container can be formed with two opposed circular segments removed and left open so that only the bridge across the top of the container remains. A cylindrical cap can be assembled to the container by insertion of the cap into the open bottom of the container and snapping it past a retaining bead on the internal wall of the container adjacent the open top so that the cap is retained for rotation relative to the container with the flat top of the cap against the inner surface of the bridge. The skirt portion of the cap occupies the removed segment portion of the container and it contains a circumferential dispensing window. The remainder of the skirt portion is knurled or provided with vertical flutes which allows the user to grasp the cap on either side of the bridge to rotate it from a closed position in which the dispensing window is covered by the bridge portion of the container to a dispensing position in which a desired amount of the dispensing window has been rotated past the bridge. This dispenser can be provided with a tamper indicating removable tab which cooperates between the cap and the container to prevent rotation of the cap relative to the container until the tab has been broken away, which again, provides a visible indication that the container has been opened. The removable tab is formed most readily as a portion of the container and as a wedge shaped tab united to the top by a frangible web connecting it to the bridge and another frangible web attaching the tab to the cylindrical side wall of the container. The tab thus extends into one of the segmental openings with one side of the wedge shaped tab being located along the chordal side of the bridge affixed thereto by a frangible web, and the other frangible web being located between a bottom surface of the wedge and the inside cylindrical wall of the container. The cylindrical cap is formed with a complementary wedge shaped slot so that when the cap is pushed into the container bottom, the tab is aligned with the slot to receive it as the cap is snapped into place, being held by the container retaining bead. The tab thus prevents rotation of the cap from its closed position with the bridge covering the dispensing window, and the tab is clearly visible to indicate the unopened condition of the package. The tab is removed by a prying action breaking the frangible webs. The dispensing window in the cap is located adjacent the wedge shaped cutout for the locking tab so that the absence of the tab is clearly visible to the observer. The container can be provided with an inwardly extending axial projection along one vertical edge of the bridge so that it engages the vertical flutes on the cap to act as a ratchet or detent to hold the cap in a stationary position once it has been rotated to the desired dispensing position.

BRIEF DESCRIPTION OF THE DRAWINGS

The preferred embodiments of the invention are illustrated in the drawing in which:

FIG. 7 is a partial perspective view showing the details of a tamper indicating tab applied to the dispensing package of FIG. 6;

FIG. 8 is a partial perspective view similar to FIG. 7 showing the locking tab partially removed;

FIG. 9 is a view of the cap windows in dispensing position after removal of the tamper indicating tab;

FIG. 10 is a fragmentary perspective view showing the details of the detent locking of the cap to the container; and FIG. 11 is a fragmentary plan view in section showing the details of the holding mechanism shown in FIG. 10.

DESCRIPTION OF THE PREFERRED EMBODIMENTS

Figure 1:
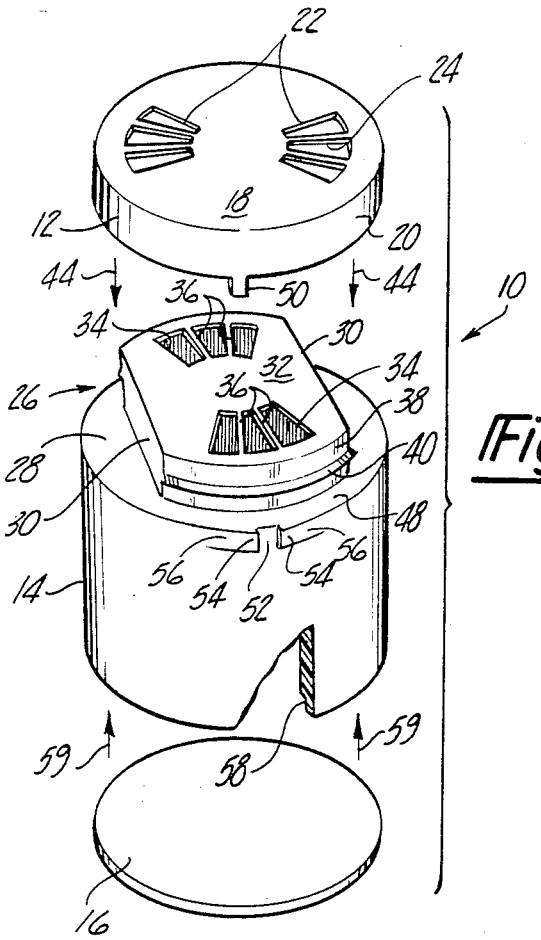
FIG. 1 is an exploded perspective view of the cap, container and bottom of the dispensing package embodying the invention.
Figure 2:
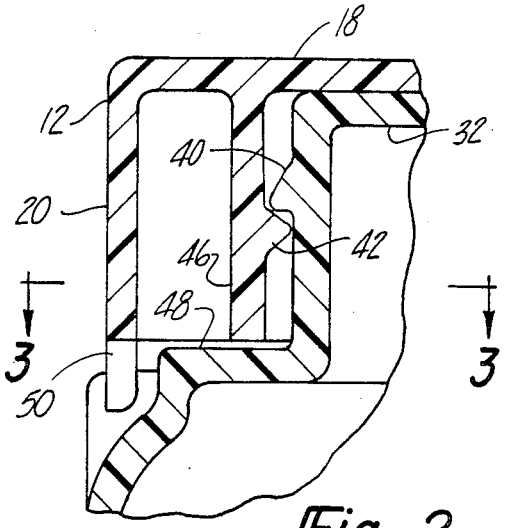
FIG. 2 is a fragmentary elevational view in partial cross-section showing the cap assembled to the container in the closed position with the cap locking lug engaging the container recess.
Figure 3:
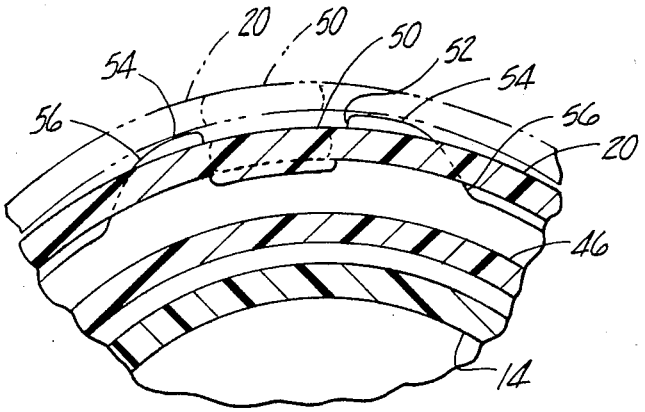
FIG. 3 is a fragmentary plan view of the dispensing package of FIG. 1 taken along line 3—3 of FIG. 2 showing the engagement of the cap locking lug with the container recess in its normal position and in its unlocked position in dotted lines when the cap has been squeezed to release the locking lug.

Referring to FIGS. 1 through 3, a safety or child resistant package 10 is shown consisting of three parts which are assembled together, namely, the cap 12, container 14, and bottom 16. Cap 12 is formed with a flat top 18 and a depending cylindrical skirt 20. Top 18 has two diametrically opposed dispensing windows 22 which are conveniently in the form of circumferential slots having dividing partitions 24. The top 26 of container 14 is molded with two diametrically opposed cutout portions 28 which are preferably in the form of circular segments, although they could be made in the form of annular or wedge shaped recesses. The circular segments 28 are molded to a depth equal to approximately the height of the cap skirt 20 defining two vertical chordal surfaces 30 and a bridge 32 joining the tops of surfaces 30. The bridge 32 is formed with two diametrically opposed circumferential slot windows 34 having partitions 36. The cylindrical end portions 38 of bridge 32 are formed with outwardly extending circumferential beads 40 which are adapted to coact with a corresponding inwardly projecting bead 42 on cap 12. Cap 12 is assembled to container 14 by pushing the skirt 20 over the container downwardly in the direction of arrows 44 in FIG. 1, so that cap bead 42 slides over and axially past container bead 40 to snap into position whereby coaction of the two beads retains the cap for rotation relative to the container. Cap 12 is preferably formed, as shown in FIG. 2, as having a double wall consisting of the cylindrical skirt 20 and an inner wall 46. In this case, the inwardly projecting bead 42 would be formed on the inside of the inner wall 46 rather than on the outer wall or cap skirt 20. With a double wall cap, the container would be formed with a shoulder 48 and cylindrical end walls 38 would align with cap inner wall 46 for proper coaction of beads 40 and 42. Dispenser package 10 is made child resistant by molding the cap 12 with two diametrically opposed axial locking lugs 50 depending from skirt 20 equally spaced from dispensing windows 22, i.e. the center of locking tabs 50 is in a plane perpendicular to a plane through the center line of the dispensing windows 22. Container 14 has complementary recesses 52 which are diametrically opposed and aligned for receiving locking lugs 50. Each recess is formed by a pair of spaced ears 54 located below bridge 32 and aligned with container windows 34. When cap 12 is assembled to container 14, locking lugs 50 are aligned with recesses 52 so that when the cap 12 is pushed onto container 14 in the direction of arrows 44, lugs 50 will be in locking engagement with recesses 52 as the cap is snapped onto the container by the engagement of the complementary beads. In this first position, the cap is locked relative to the container 14 and the dispensing windows 22 of cap 12 are out of alignment with dispensing windows 34 of container 14. In order to release cap 12 for rotation it is necessary to squeeze the cap skirt 20 below windows 22 pushing the skirt toward the chordal surfaces 30 of container 14 thereby flexing skirt 20 outward at locking lugs 50 moving them out of recesses 52, as shown by the dashed line portion of FIG. 3. With this release the cap can be rotated to the second dispensing position in which the cap windows 22 are aligned with the container windows 34 to the extent desired for dispensing the contents of the container. The maximum opening is obtained when the cap windows 22 are in complete alignment with container windows 34. Ears 54 are formed with camming ramps 56 which slope inwardly from recessed opening 52 to the container wall so that when the cap 12 is rotated from the second dispensing position to the first closed position, the locking lugs 50 will ride up over the ramp surfaces 56 and fall into recesses 52. The container 14 is filled through its open bottom after the cap has been snapped into place in its locked position. Finally, bottom 16 is snapped into receiving groove 58 in the bottom of container 14, as shown by arrows 59 in FIG. 1.

Figure 4:
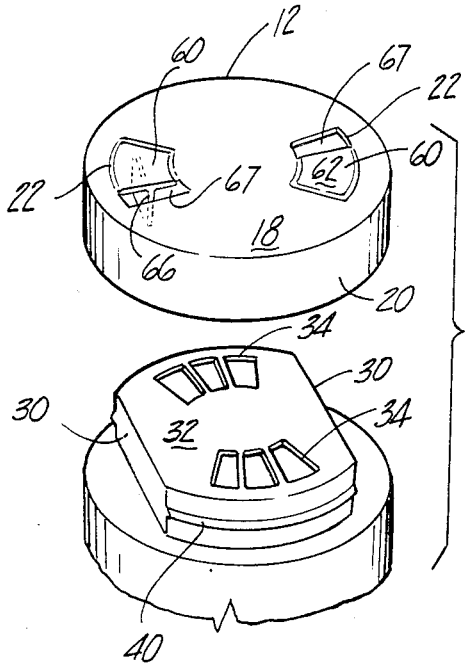
FIG. 4 is an exploded perspective view of the cap and container of another embodiment of the invention showing tamper indicating tabs removably affixed in the dispensing windows of the cap and their relationship to the chordal locking surfaces on the container.
Figure 5:
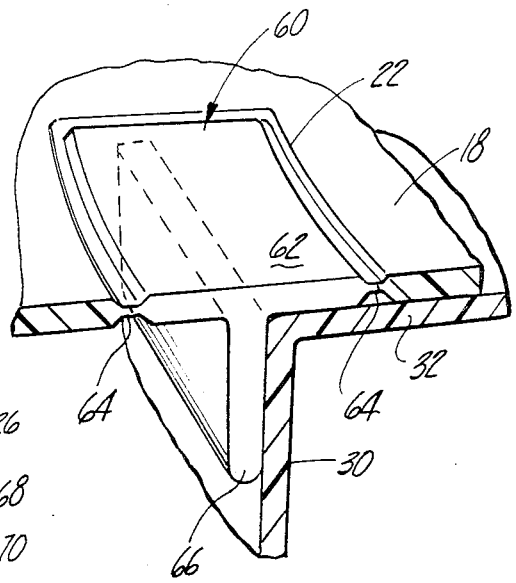
FIG. 5 is a fragmentary perspective view partially in section showing the details of the tamper indicating locking tab on the cap and its coaction with the chordal locking surface on the container.

A tamper indicating closure is shown in FIGS. 4 and 5 which is created by forming removable tamper indicating locking tabs 60 integral with and occupying a substantial portion of the cap dispensing windows 22. These removable tamper indicating tabs 60 are formed with a top surface 62 attached to and forming a part of the top surface 18 of the cap by frangible connecting webs 64. Webs 64 join the top surface 62 of tab 60 to the top 18 at the radially inward and radially outward circumferential sides of the dispensing windows. The flat top portions 62 of the tabs 60 have depending flanges 66 which engage the chordal surfaces 30 of the container when the cap is snapped into position on the container. This prevents rotation of the cap until these tamper indicating tabs 60 are removed by inserting an implement or finger into the open portion 67 of the dispensing windows 22 and pulling upward on tab 60 to break the two circumferential frangible webs 64. Both tabs must be removed before the cap can be rotated to a dispensing position. The flange 66 can merely be adjacent to the parallel chordal surface 30, but it must be close enough to engage upon any attempted rotation. Tabs 60 provide an easily observed tamper indication to indicate whether or not the package has been opened.

Figure 6:
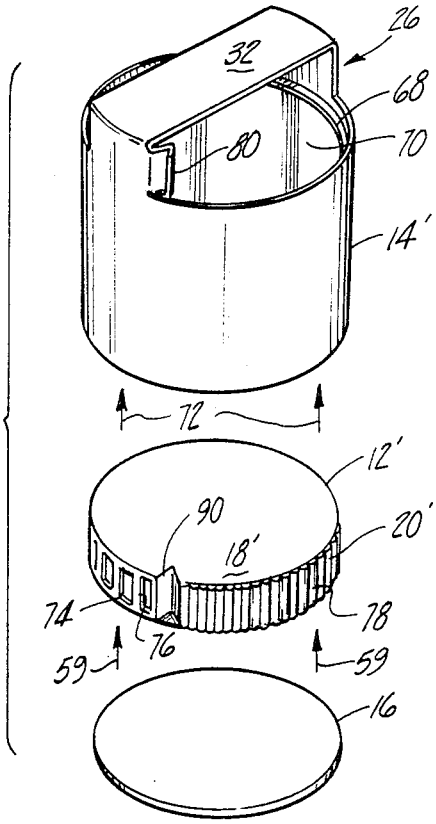
FIG. 6 is an exploded perspective view showing another embodiment of the invention.

Another tamper indicating embodiment of the safety dispenser is shown in FIGS. 6–11 wherein the top 26 of the container 14' is formed with two opposed circular segments removed and left open so that only the bridge 32 across the top of the container remains. The cylindrical cap 12' is assembled to the container 14' by inserting it into the opened bottom and snapping it past retaining bead 68 on the inside of container 14' adjacent to open area 70 so that the cap is retained for rotation relative to the container with the flat top 18' of the cap against the inner surface of bridge 32. Arrows 72 in FIG. 6 show that the cap 12' is inserted through the open bottom of container 14'. The skirt portion 20' of cap 12' occupies the removed segment portion 70 of the container and it contains a circumferential dispensing window 74 having a partition 76. Skirt 20' is provided with vertical flutes 78 around its extent which allows the user to grasp the cap on either side of bridge 32 to rotate it from a closed position in which the dispensing window 74 is covered by the bridge portion 32 of the container to a dispensing position in which the desired amount of the dispensing window 74 has been rotated past the bridge 32 as shown in FIG. 9. A tamper indicating removable tab 80 cooperates between the cap and the container to prevent rotation of the cap relative to the container until the tab has been broken away. Tab 80 is in the form of a wedge having vertical side walls 82 and a bottom wall 84 and it is molded as part of the container, united to the top of bridge 32 by a frangible web 86. Another frangible web 88 connects the bottom 84 of the tab 80 to the cylindrical side wall of the container. Tab 80 thus extends into one of the segmental openings 70 with one side 82 being located along the chordal side 30 of the bridge 32. The cylindrical cap 12' is formed with a complementary wedge shaped slot 90 so that when the cap 12' is pushed into the container bottom in a direction of arrows 72, the tab 80 is aligned with the slot 90 which receives it as the cap is snapped into place. The tab 80 thus prevents rotation of the cap from its closed position with the bridge 32 covering the dispensing window 74, and the tab 80 is clearly visible to indicate the unopened condition of the package. The tab 80 is removed by a prying action which breaks the frangible webs 86 and 88 as shown in FIG. 8. The dispensing window 74 in cap 12' is located adjacent the web shaped cutout 90 for the locking tab so that the absence of the tab is clearly visible to the observer indicating an initial opening of the container, see FIG. 9. As shown in FIGS. 10 and 11, an inwardly extending axial projection 92 is formed along one vertical edge of the bridge 32 so that it engages the vertical flutes 78 on the cap 12' acting as a detent or ratchet to hold the cap in a stationary position once it has been rotated to a desired dispensing or closed position.

As will be readily apparent, many modifications can be made to the illustrated embodiments within the scope of the invention. For example, in the embodiments shown in FIGS. 1–5, the cap 12 could be connected for rotation to the container 14 by a centrally located downwardly extending retention boss on top 18 of cap 12 which coacts with a central aperture in bridge 32 of container 14, eliminating coacting beads or flanges 40 and 42. The same type of boss and aperture connection could be made in the embodiment shown in FIGS. 6–11, eliminating bead 68. The use of tamper indicating tabs 60 of FIGS. 4 and 5 could be combined with the use of child resistant tabs 50 of FIGS. 1–3. It should also be understood that while the container is characterized as being cylindrical or as having a cylindrical side wall, only that portion of the container which coacts with a circular cylindrical cap need be formed with a circular cylindrical surface, the balance of the container body being formed in any convenient shape. The container bottom, for example, could be square, accepting a square snap-in plug.

The embodiments of the invention in which an exclusive property or privilege is claimed are defined as follows:

1. A safety dispenser comprising, in combination: a cylindrical container having an open bottom, cylindrical sidewall and a top formed with two diametrically opposed circular segments removed, establishing therebetween a closed bridge, said bridge containing a circumferential slot window; a cylindrical cap having a depending annular skirt and flat top; means affixing said cap to said container for rotation relative thereto; said cap having a circumferential slot dispensing window located on the flat top thereof so that when said cap is rotated, said cap window can be rotated from a first position wherein it is closed by said container to a second position in line with said container window for dispensing the contents of said container; a tamper indicating locking tab occupying a substantial portion of said cap dispensing window, said tab having a top surface attached to and forming a part of the top of said cap, said attachment being by frangible web means, said tab having a depending flange which engages the chordal surface formed by the removal of one of said opposed circular segments when said cap is initially assembled to said container in said first closed position, whereby said cap is locked in said closed position, and said web must be removed in order to rotate said cap to said second open position, the removal of said tab indicating initial opening or tampering of the dispenser; and a container bottom for closure of said container after filling with a product to be dispensed therefrom.

2. The safety dispenser of claim 1 wherein said container bottom is formed as a plug for insertion into the open bottom end of said container.

3. The safety dispenser of claim 2 wherein said container is formed with an internal peripheral groove adjacent its open bottom to receive said container bottom snapped therein.

4. The safety dispenser of claim 1 wherein said container and cap each have two diametrically opposed circumferential slot windows which can be aligned for dispensing in said second position, said container windows being covered by said cap when said cap is in said first closed position, each of said cap dispensing windows having a tamper indicating locking tab therein, both of which must be removed for rotation of said cap to said second open position.

5. The safety dispenser of claim 4 wherein the means affixing said cap to said container includes a radially inwardly extending circumferential bead on said cap skirt and a radially outwardly extending circumferential bead on said container whereby said cap is assembled to said container by pushing said cap onto said container, snapping said beads axially past each other, and the coaction of said beads retain said cap for rotation relative to said container.

6. A tamper indicating dispenser, comprising, in combination: a cylindrical container having an open bottom, a cylindrical side wall and a top with a peripheral opening therein; a cylindrical cap having a depending annular skirt and a flat top and being inserted into the open bottom of said container; means affixing said cap for rotation relative to said container with the flat top of said cap against the internal top of said container, the peripheral opening of said container extending down said cylindrical sidewall to expose said skirt; said skirt having a dispensing window therein whereby when said cap is rotated by grasping the exposed portion of said skirt, said window is rotated from a first position wherein it is closed by said container sidewall to a second position in line with said peripheral opening for dispensing the contents of said container; a removable tab cooperating between said cap and said container to prevent rotation of said cap relative to said container until said tab is broken away, said tab being visible to indicate the container has not been initially opened, and the absence of said tab being apparent to indicate initial opening of said container; a container bottom for closure of said container after filling with a product to be dispensed therefrom.

7. The tamper indicating dispenser of claim 6 wherein said cap is retained within said container by an inwardly projecting bead on the interior of said side wall.

8. The tamper indicating dispenser of claim 6 wherein said container bottom is formed as a plug for insertion into the open bottom end of said container.

9. The tamper indicating dispenser of claim 8 wherein said container is formed with an internal peripheral groove adjacent its open bottom to receive said container bottom snapped therein.

10. The tamper indicating dispenser of claim 6 wherein said tab is removably affixed to said container and extends into said peripheral opening, said tab engaging a slot in said cap preventing rotation of said cap until said tab is broken away.

11. The tamper indicating dispenser of claim 10 wherein said tab has a frangible web joining said tab to the top of said container and another frangible web attaching said tab to said cylindrical side wall, whereby said tab is removed by breaking said webs.

12. The tamper indicating dispenser of claim 6 wherein said depending annular skirt is formed with vertical flutes which assist in turning said cap.

13. The tamper indicating dispenser of claim 12 wherein said container is formed with an inwardly extending axial projection which engages said vertical flutes on said cap to hold said cap stationary in said first and second positions.

14. The tamper indicating dispenser of claim 6 wherein said peripheral opening is formed as a circular segment.

15. The tamper indicating dispenser of claim 14 wherein said peripheral opening is formed as two diametrically opposed circular segments establishing therebetween a closed bridge providing opposed gripping areas through said segments for the thumb and forefingers, and said bridge portion providing for closure of said dispensing window in said first position and said cap being in said second dispensing position when aligned with either of said segmental openings.

16. The tamper indicating dispenser of claim 15 wherein said removable tab is affixed to said bridge by a frangible web, said tab extending into one of said segmental openings and engaging a slot in said cap which prevents rotation of said cap until said tab is broken away by severing of said frangible web.

17. A safety dispenser comprising, in combination: a cylindrical container having an open bottom, a cylindrical sidewall and a top molded with two diametrically opposed circular segments removed to a depth to accommodate the height of a cap skirt defining two vertical chordal surfaces and a bridge joining the tops of said chordal surfaces; two diametrically opposed circumferential slot windows formed in said bridge; a cylindrical cap having a depending skirt and a flat top containing two diametrically opposed circumferential dispensing slot windows, means affixing said cap to said container for rotation relative thereto, said cap windows being so positioned that as said cap is rotated, said cap windows can be rotated from a first closed position with said dispensing windows out of registration with each other to a second open position wherein said dispensing windows are aligned for dispensing the contents of said container; a tamper indicating locking tab occupying a substantial portion of one of said cap dispensing windows, said tab having a top surface attached to and forming a part of the top of said cap, said attachment being by fragible web means, said tab having a depending flange which engages one of said chordal surfaces when said cap is initially assembled to said container in said first closed position, whereby said cap is locked in said closed position, and said web must be removed in order to rotate said cap to said second open position, the removal of said tab indicating initial opening or tampering of the dispenser; and a container bottom for closure of said container after filling with a product to be dispensed therefrom.

18. The safety dispenser of claim 17 wherein each of said cap dispensing windows has a tamper indicating locking tab therein, the depending flanges of each engaging one of said chordal surfaces, whereby both of said tabs must be removed for rotation of said cap to said second open position.

19. The safety dispenser of claim 18 wherein said frangible web means includes a circumferential frangible web on the radially inward and radially outward side of said dispensing windows joining the top surfaces of said tabs to the top of said cap.

20. A safety dispenser comprising, in combination: a cylindrical container having an open bottom, a cylindrical side wall and a top molded with two diametrically opposed circular segments removed to a depth approximately the height of a cap skirt defining two parallel, vertical chordal surfaces and a bridge joining the tops of said chordal surfaces, said bridge being formed with two diametrically opposed circumferential slot windows; a cylindrical cap having a depending skirt and a flat top with two diametrically opposed circumferential slot windows, and a tamper indicating locking tab for each of said windows occupying a substantial portion of said cap dispensing windows, each tab having a top surface attached to and forming a part of the top of the said cap, said attachment being by a frangible web means, each tab having a depending flange which engages said chordal surface when the cap is intially assembled to said container for rotation relative thereto in a first closed position, whereby said cap is locked in said closed position, and said web must be removed in order to rotate said cap to a second open position, wherein said windows are aligned for dispensing the contents of said container, the removal of said tabs indicating initial opening or tampering of the dispenser; a container bottom for closure of said container after filling with a product to be dispensed therefrom.

21. The safety dispenser of claim 20 wherein said cap is affixed to said container by a radially inwardly extending circumferential bead on said cap skirt and a radially outwardly extending circumferential bead on said container whereby said cap is assembled to said container by aligning said depending flanges of said tamper indicating locking tabs with said chordal surfaces and pushing said cap onto said container, snapping said beads axially past each other, the coaction of said beads retaining said cap for rotation relative to said container.

22. The safety dispenser of claim 20 wherein said frangible web means includes a circumferential frangible web on the radially inward and radially outward sides of said dispensing windows joining the top surfaces of said tabs to the top of said cap.

23. A safety dispenser comprising, in combination: a cylindrical container having an open bottom, a cylindrical sidewall and a top formed with two diametrically opposed circular segments removed to the height to accommodate a cap skirt, establishing therebetween a bridge closed on top and open in the areas where said segments have been removed; a cylindrical cap having a depending annular skirt and a flat top inserted into the open bottom of said container; means affixing said cap to said container for rotation relative thereto with the flat top of said cap against said bridge, said skirt portion of said cap containing a dispensing window whereby when said cap is rotated by grasping the exposed portions of said skirt, said window is rotated from a first position wherein it is closed by said bridge to a second open position in line with one of said circular segment areas for dispensing the contents of said container; and a container bottom for closure of said container after filling with a product to be dispensed therefrom.

24. The dispenser of claim 23 further comprising a removable tab cooperating between said cap and said container to prevent rotation of said cap relative to said container until said tab is broken away, said tab being visible to indicate the container has not been initially opened, and the absence of said tab being apparent to indicate initial opening of said container.

25. The tamper indicating dispenser of claim 24 wherein said tab is removably affixed to said container and extends into the area of one of said circular segments, said tab being affixed by frangible webs joining it to the top and cylindrical side wall of said container, and said tab engaging a slot in said cap preventing rotation of said cap until said frangible webs are broken and said tab is removed.

* * * * *